US005667946A

United States Patent [19]

Boff et al.

[11] Patent Number: 5,667,946

[45] Date of Patent: Sep. 16, 1997

[54] PHOTOGRAPHIC MATERIAL CONTAINING MAGENTA DYE FORMING COUPLER

[75] Inventors: Jane Sarah Boff, St. Albans; Bernard Arthur Clark, Maidenhead; Paul Louis Stanley, Harrow; Christina Mary Watts, Harold Weald, all of United Kingdom; Stephen Paul Singer, Spencerport, N.Y.

[73] Assignee: Eastman Kodak Company, Rochester, N.Y.

[21] Appl. No.: 640,026

[22] Filed: Apr. 30, 1996

[51] Int. Cl.[6] ..... G03C 7/384

[52] U.S. Cl. ..... 430/386; 430/387; 430/554; 430/555; 430/549

[58] Field of Search ..... 430/554, 555, 430/549, 386, 387

[56] References Cited

U.S. PATENT DOCUMENTS

| | | | |
|---|---|---|---|
| 3,468,665 | 9/1969 | Misu | 430/554 |
| 4,163,670 | 8/1979 | Shiba et al. | 96/74 |
| 4,388,404 | 6/1983 | Morigaki et al. | 430/555 |
| 4,411,987 | 10/1983 | Kobayashi et al. | 430/554 |
| 4,444,870 | 4/1984 | Hirano et al. | 430/554 |
| 4,522,915 | 6/1985 | Ichijima et al. | 430/505 |
| 4,663,272 | 5/1987 | Nakamura | 430/555 |
| 5,091,293 | 2/1992 | Nozawa et al. | 430/555 |

FOREIGN PATENT DOCUMENTS

| | | | |
|---|---|---|---|
| 12836 | 7/1966 | Japan | 430/554 |
| 110150 | 4/1994 | Japan . | |
| 1066334 | 4/1967 | United Kingdom | 430/554 |
| 1455967 | 11/1976 | United Kingdom . | |

*Primary Examiner*—Lee C. Wright
*Attorney, Agent, or Firm*—Arthur E. Kluegel

[57] ABSTRACT

The invention provides a light sensitive photographic silver halide emulsion layer having associated therewith a magenta coupler having formula I:

(I)

wherein:

R represents a ballasted monosubstituted amino group which enables the coupler to form, upon development with 4-amino-3-methyl-N-ethyl-N-(2-hydroxyethyl) aniline sulfate developing agent, a magenta dye having a wavelength of maximum absorbance of 545 nm or greater; and X represents hydrogen or a coupling-off group. The resulting dye has an improved spectral absorption curve.

20 Claims, No Drawings

PHOTOGRAPHIC MATERIAL CONTAINING MAGENTA DYE FORMING COUPLER

FIELD OF THE INVENTION

This invention relates to color photographic film elements with improved light stability and color reproduction containing 1-(4-chlorophenyl)-3-(monosubstituted amino)-5-pyrazolone magenta dye forming couplers.

BACKGROUND OF THE INVENTION

1-Phenyl-5-pyrazolones with 3-(monosubstituted amino) groups such as anilino and acylamino in the 3-position are well known in the photographic art as magenta dye forming couplers. The 1-phenyl group in these couplers can be substituted with a wide range of groups in different combinations or positions to give materials with desired properties. It is widely recognized that chloro groups are excellent substitutents for the 1-phenyl group, with at least two, or more preferably three, chlorines present. It is also known that at least one, or more preferably two, of these chloro groups be in the ortho position of the phenyl ring in order to improve keeping and improve light absorbance; for examples, see GB U.S. Pat. No. 1,494,777 or U.S. Pat. No. 3,926,631. Typically, 2,4,6-trichlorophenyl is a highly preferred group in the 1-position of a 3-(monosubstituted amino)-5-pyrazolone magenta dye forming coupler.

Known 1-phenyl-3-(substituted amino)-5-pyazolone magenta dye forming couplers suffer from numerous deficiencies in photographic film elements. The light stability of the magenta dye that is formed after processing could be improved on. The magenta dye formed may be too hypsochromic for achieving good color accuracy in some formats and such dyes tend to have more than desired unwanted blue absorbance. In addition, as discussed in, for example, U.S. Pat. No. 5,447,831 and U.S. Pat. No. 5,455,150, magenta dyes formed from 1-phenyl-3-anilino-5-pyrazolones lack density in the 550–580 nm spectral region relative to other classes of magenta dyes used in photographic systems, which can lead to printer compatibility problems where one type of printer may read two different films as identical while another does not. In some cases, the magenta dyes can be prone to form aggregates in the film that are not magenta in hue. This causes hue shifts as a function of exposure. In addition, magenta couplers need to have high activity towards oxidized developer in order to maximize system efficiency.

British Patent Specification 1,173,513 describes the use of 3,4,5-trichloro or 3,4-dichloro substituted 1-phenyl-3-acylamino-5-pyrazolone couplers. However, these couplers are prone to aggregation and to exposure-dependent hue shifts. A 4-chlorophenyl group as a generic 1-substituent has been listed along with numerous other possibilities in U.S. Pat. Nos. 4,268,592, 4,297,440, 4,199,361 and 4,336,325 but no examples of complete coupler compounds having such 1-substituents are mentioned.

U.S. Pat. No. 3,928,044 proposes 1-phenyl-3-(5-alkyloxycarbonylanilino)-5-pyrazolone couplers in which the anilino ring contains an ortho substituent and contains an ester substituent in the meta or para position. The patent is extremely broad as to the substituents that may be employed on the 1-phenyl ring, the common 2,4,6-trichloro phenyl ring being most prominent. The only specific coupler mentioned having a 4-chloro phenyl ring in the 1-position is compound 36 in column 8 of the patent. However, such couplers having the indicated ester and other substituents on the anilino ring result in magenta dyes that are too hypsochromic in terms of λmax when developed in accordance with the conventional Kodak Flexicolor® C41 process. It appears from the specification that the presence of a substituent in the ortho position of the 1-phenyl group is either preferred or essential. If the coupler contains an ortho chloro group as specified, then the dye would also be too narrow in bandwidth and have insufficient density at 580 nm.

A specific example of a 1-(4-chlorophenyl)-3-anilino-5-pyrazolone coupler is shown as Coupler 19 in U.S. Pat. No. 4,163,670. However, this coupler contains an acylamino substituent on the anilino ring which would again produce a magenta dye that is too hypsochromic in terms of λmax.

Compound (5) of U.S. Pat. No. 4,522,915, is another specific example of a 1-(4-chlorophenyl)-3-acylamino-5-pyrazolone coupler. However, this coupler would produce a dye that is too hypsochromic in terms of λmax and that is unballasted and thus not suitable as an imaging component in a photographic element.

British Patent Specification 1,399,306 describes 1-phenyl-3-anilino-5-pyrazolone couplers having substituted carbamoyl or sulfamoyl groups in the anilino ring but whose 1-phenyl group is limited to a 2,4,6-trichlorophenyl group. Such materials have insufficient light stability and activity towards oxidized developer in addition to having insufficient density at 580 nm.

A problem to be solved is to provide a photographic silver halide emulsion layer which exhibits a desired combination of color reproduction capability and dye light stability.

SUMMARY OF THE INVENTION

The invention provides a light sensitive photographic silver halide emulsion layer having associated therewith a magenta coupler having formula (I):

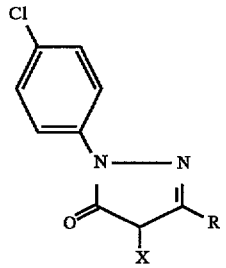

(I)

wherein:

R represents a ballasted monosubstituted amino group which enables the coupler to form, upon development with 4-amino-3-methyl-N-ethyl-N-(2-hydroxyethyl) aniline sulfate developing agent, a magenta dye having a wavelength of maximum absorbance of 545 nm or greater; and X represents hydrogen or a coupling-off group.

The invention also includes a multilayer photographic color element containing the emulsion layer of the invention and a method of forming an image in such an element.

The invention provides a photographic silver halide emulsion layer which exhibits a desired combination of color reproduction capability and dye light stability.

DETAILED DESCRIPTION OF THE INVENTION

The invention provides a light sensitive photographic silver halide emulsion layer having associated therewith a magenta coupler having formula (I):

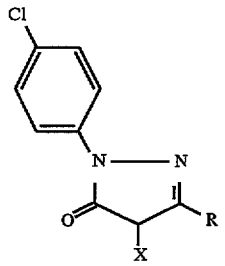

(I)

wherein:

R represents a ballasted monosubstituted amino group which enables the coupler to form, upon development with 4-amino-3-methyl-N-ethyl-N-(2-hydroxyethyl) aniline sulfate developing agent, a magenta dye having a wavelength of maximum absorbance of 545 nm or greater; and X represents hydrogen or a coupling-off group.

More preferably, the magenta couplers of the invention are represented by formula (II):

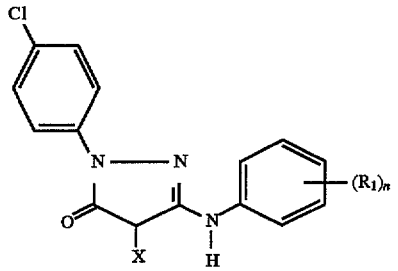

(II)

wherein:

X is as above;

each $R_1$ independently represents a substituent such that the sum total of their Hammett σ-para constants is 0.68 or greater, and n=1 to 5; provided that the selection of the $R_1$ substituents is sufficient to ballast the coupler.

The most preferred magenta couplers of the invention are represented by general formula (III):

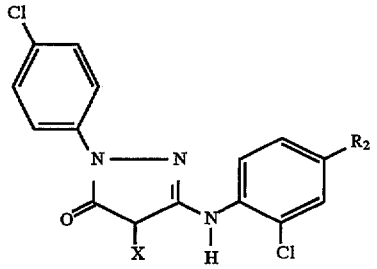

(III)

wherein:

X is as above;

$R_2$ is a ballasted sulfone ($—SO_2R_3$), sulfamoyl ($—SO_2NR_3R_4$) or carbamoyl ($—CONR_3R_4$) group in which $R_3$ is an alkyl or aryl group and $R_4$ is hydrogen or an alkyl or aryl group.

It is believed that the proper selection of substituents for $R_1$, and $R_2$ can be accomplished by calculating the sum of the Hammett's Sigma constant values for all of the ring substituents. The $R_1$ or $R_2$ substituents are independently selected from the groups usable as substituents described hereinafter, provided that there are among these substituent groups sufficient electron withdrawing capacity such that the sum of the Hammett's constant values for all R substituents ($\sigma_p$ for an ortho or para position or $\sigma_m$ for a meta position depending on the location of each said $R_1$ or $R_2$ group relative to the nitrogen atom linking the phenyl ring to the pyrazolone ring) is at least 0.68. See "Survey of Hammett Substituent Constants and Resonance Field Parameters", C. Hansch, A. Leo, and R. Taft, Chem. Rev., 91, 165–195, (1991), for a definition of the terms and for a table of constant values for various substituents.

In the Hammett system, since positive σ values represent electron withdrawing character and since the value for hydrogen is 0, it follows that a sum of 0.68 can only be achieved by the presence of at least one electron withdrawing group. Examples of useful electron withdrawing substituents include halogen, $—NO_2$, —CN, $—NR'SO_2R''$, —NR'C(O)R", —C(O)N(R')R", —C(O)OR', —OC(O)R', —C(O)R', $—OSO_2R'$, $—SO_2R'$, $—SO_2N(R')R''$, $—SO_2OR'$ and halogenated alkyl such as $—CF_3$ wherein each R' and R" is independently hydrogen or a substituent group. Examples of suitable specific substituents include the following: sulfamoyl, such as N-methylsulfamoyl, N-hexadecylsulfamoyl, N, N-dimethylsulfamoyl; N-[3-(dodecyloxy)propyl]sulfamoyl, N-[4-(2,4-di-t-pentylphenoxy)butyl]-sulfamoyl, N-methyl-N-tetradecylsulfamoyl, and N-dodecylsulfamoyl; sulfamido, such as hexadecylsulfamido and N-octadecylmethylsulfamido; carbamoyl, such as N-methylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; diacylamino, such as N-succinimido, N-phthalimido, 2,5-dioxo-1-oxazolidinyl, 3-dodecyl-2,5-dioxo-1-imidazolyl, and N-acetyl-N-dodecylamino; aryloxycarbonyl, such as phenoxycarbonyl and p-dodecyloxyphenoxy carbonyl; alkoxycarbonyl, such as alkoxycarbonyl containing 2 to 30 carbon atoms, for example methoxycarbonyl, tetradecyloxycarbonyl, ethoxycarbonyl, phenoxycarbonyl, benzyloxycarbonyl, and dodecyloxycarbonyl; alkoxysulfonyl, such as alkoxysulfonyl containing 1 to 30 carbon atoms, for example methoxysulfonyl, octyloxysulfonyl, tetradecyloxysulfonyl, and 2-ethylhexyloxysulfonyl; aryloxysulfonyl, such as phenoxysulfonyl, 2,4-di-t-pentylphenoxysulfonyl; alkanesulfonyl, such as alkanesulfonyl containing 1 to 30 carbon atoms, for example methanesulfonyl, octanesulfonyl, 2-ethylhexanesulfonyl, and hexadecanesulfonyl; arenesulfonyl, such as benzenesulfonyl, 4-nonylbenzenesulfonyl, and p-toluenesulfonyl. Sulfinyl and sulfoxyl compounds corresponding to the foregoing sulfonyl compounds are also suitable. The aryl portion of the 4-aryloxy group is suitably exemplified by groups such as phenyl, naphthyl, pyridinyl, pyrimidinyl, pyrazolyl, imidazolyl, quinolinyl, and the like.

Particularly suitable R groups include anilino, acylamino, and alkylamino. In the case of anilino, particularly suitable $R_1$ and $R_2$ substituents on the phenyl ring are chloride, sulfone, carbamoyl, and sulfamoyl groups.

To control the migration of either the coupler before processing or is subsequently formed dye after processing, it is necessary to include a high molecular weight hydrophobe or "ballast" group in R, $R_1$ or $R_2$. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted. Typically, the ballast includes an alkyl group of 8 or more carbon atoms, usually 12 or more carbon atoms.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of a coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A.

In particular, the present invention provides a silver halide photographic element comprising a red sensitive layer containing a coupler which reacts with oxidized developer to form a cyan dye, a blue sensitive layer that contains a coupler which reacts with oxidized developer to form a yellow dye and a green sensitive layer containing a 1-(4-chlorophenyl)-3-(substituted amino)-5-pyrazolone coupler that reacts with oxidized developer to form a magenta dye with improved properties such as high reactivity, improved light stability and improved printer compatibility.

The couplers of the invention can be used in combination with other classes of magenta dye forming couplers, either in association with the same layer or with different green sensitive layers. When used in combination with magenta dye forming couplers that have insufficient density in the 580 nm region such as 1-(2,4,6-trichlorophenyl)-3-anilino-5-pyrazolones, it is preferred that the inventive coupler be located in association with the least green light sensitive layer.

Other couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Specific examples of the magenta couplers of the invention are shown below, but the present invention should not be construed as being limited thereto.

M-1:

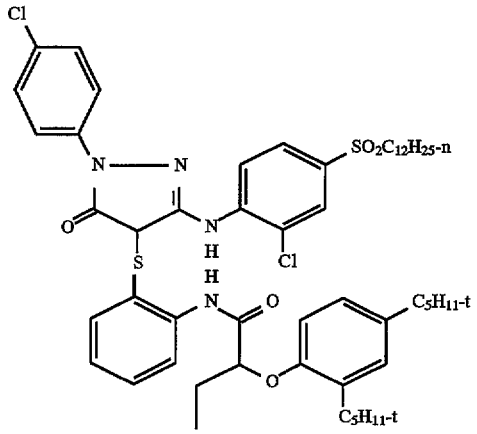

M-2:

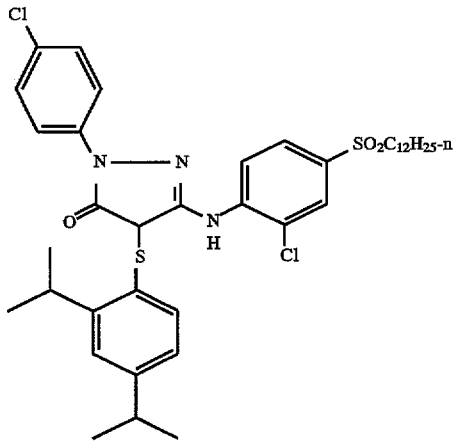

M-3:

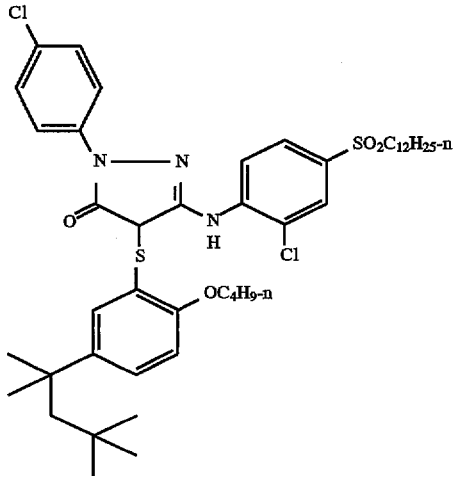

-continued
M-4:
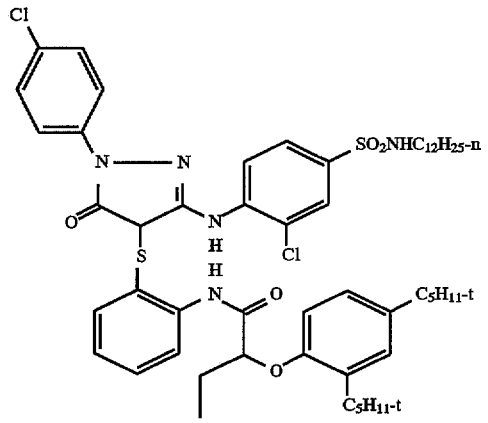
M-5:
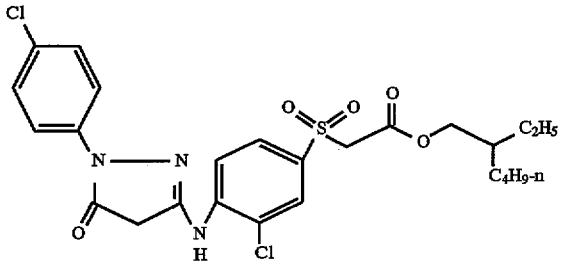
M-6:
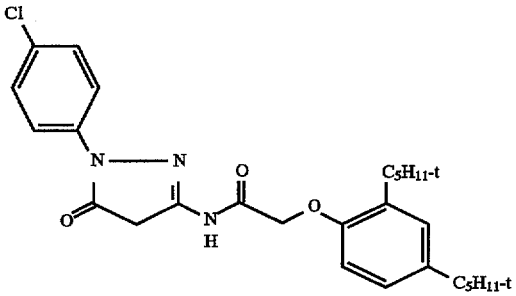
M-7:
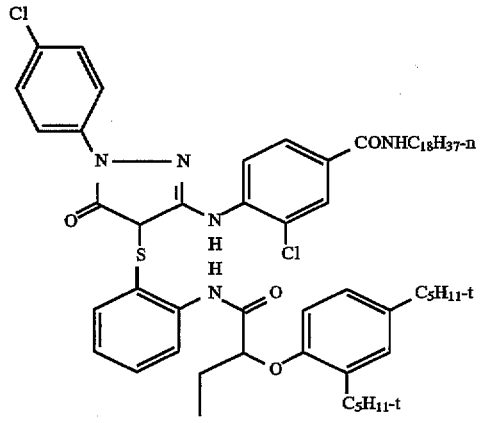
-continued
M-8:
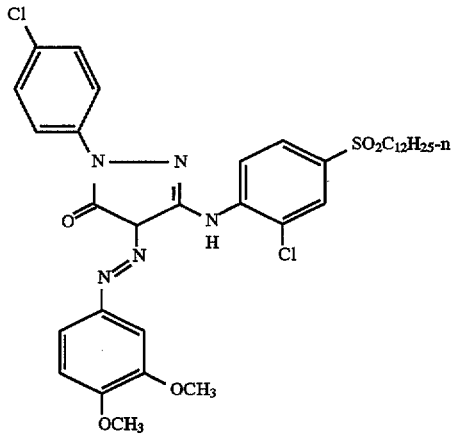
M-9:
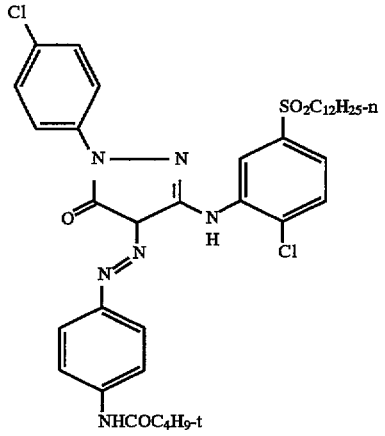
M-10:
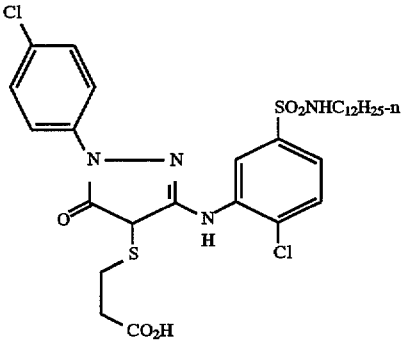

-continued

M-11:

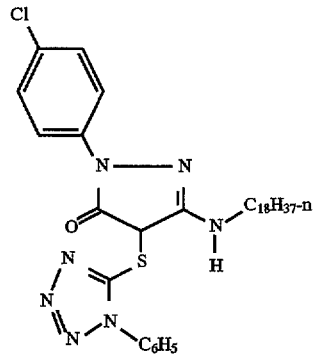

M-12:

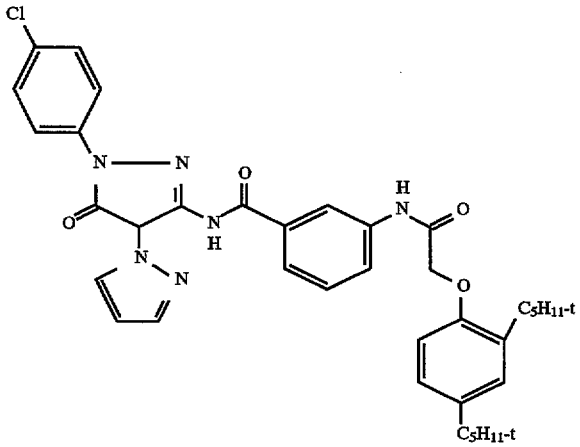

M-13:

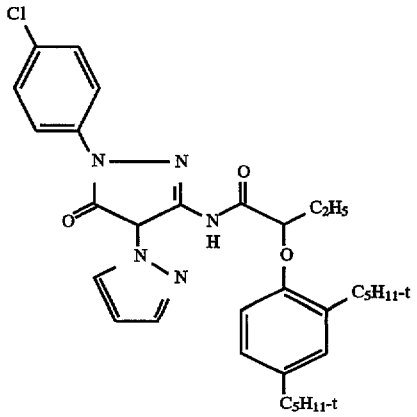

-continued

M-14:

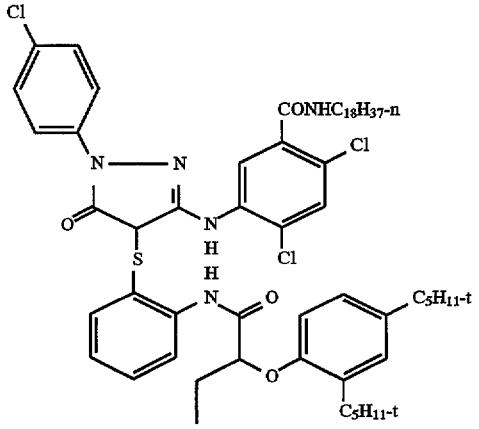

M-15:

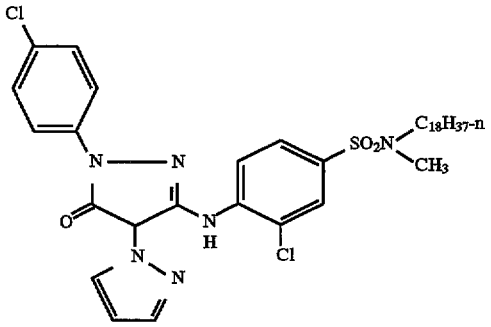

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-t-pentyl-phenoxy)acetamido, alpha-(2,4-di-t-pentylphenoxy)butyramido, alpha-(3-pentadecylphenoxy)-hexanamido, alpha-(4-hydroxy-3-t-butylphenoxy) tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine Literature Ubersicht," published in Agfa Mitteilungen, Band III, pp. 156–175 (1961). Preferably such couplers are phenols and naphthols that form cyan dyes on reaction with oxidized color developing agent.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Pat. No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227 554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985 336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

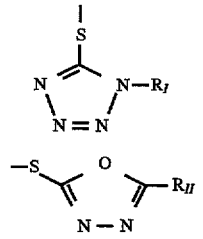

-continued

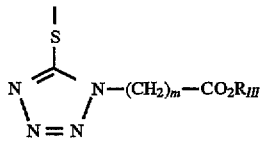

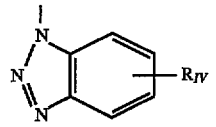

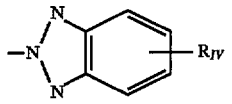

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58-209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

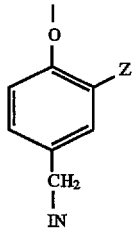

-continued

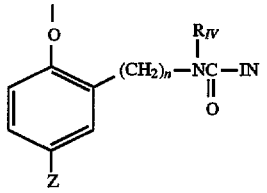

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

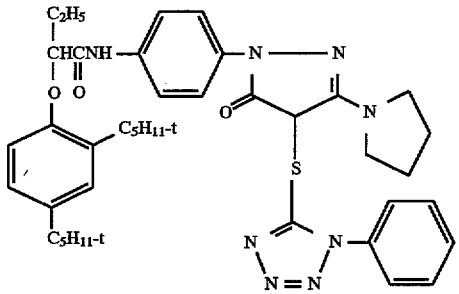

D2

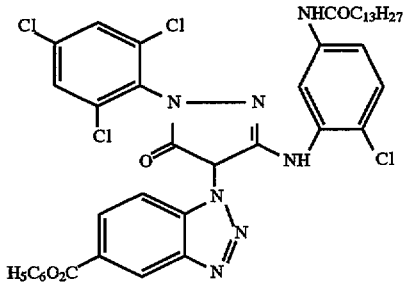

D3

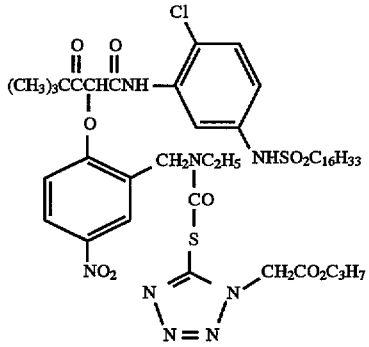

-continued
D4
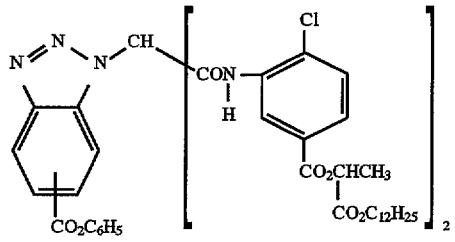
D5
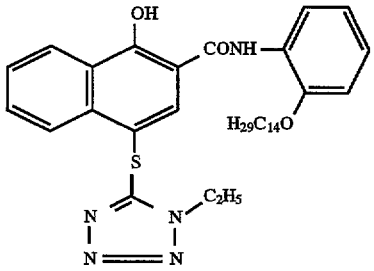
D6
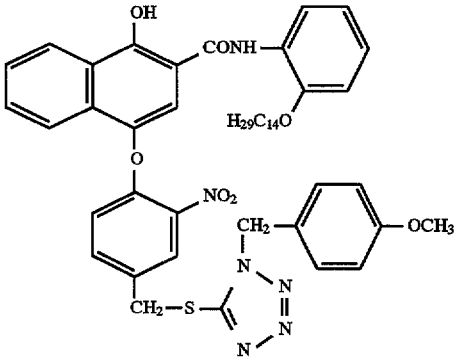
D7
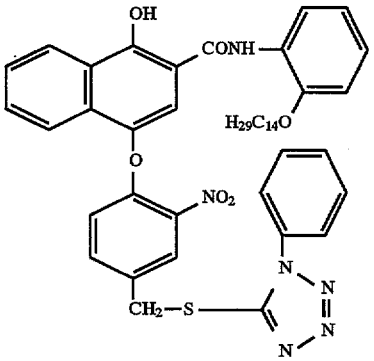
D8
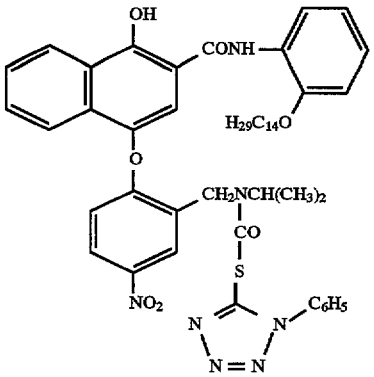
-continued
D9
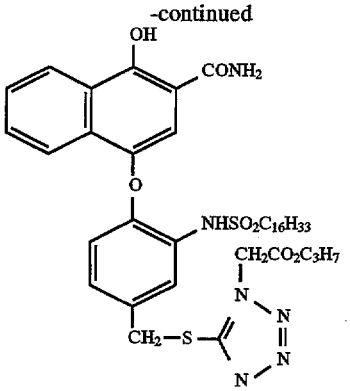
D10
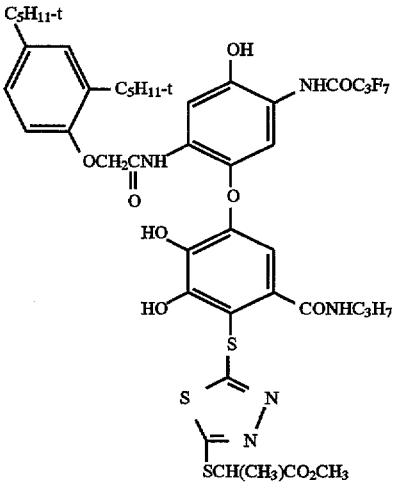
D11
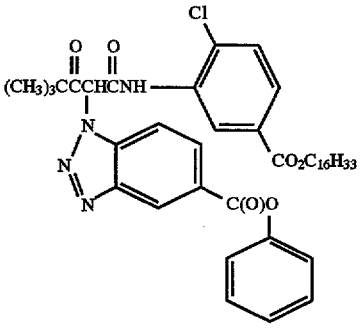
D12
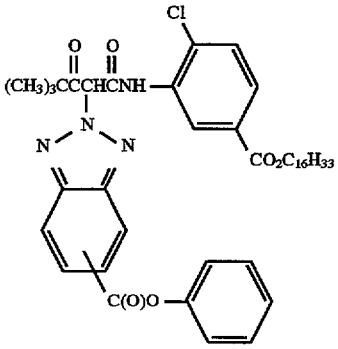
It is also contemplated that the concepts of the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England, incorporated herein by reference.

Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ micrometer) tabular grains. To achieve the lowest levels of granularity it is preferred that aim tabular grain projected areas be satisfied with ultrathin ($t<0.06$ micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known Kodak C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. Such negative working emulsions are typically sold with instructions to process using a color negative method such as the mentioned C-41 or RA-4 process. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl) aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

EXAMPLES

Synthetic Example: Synthesis of coupler M-1

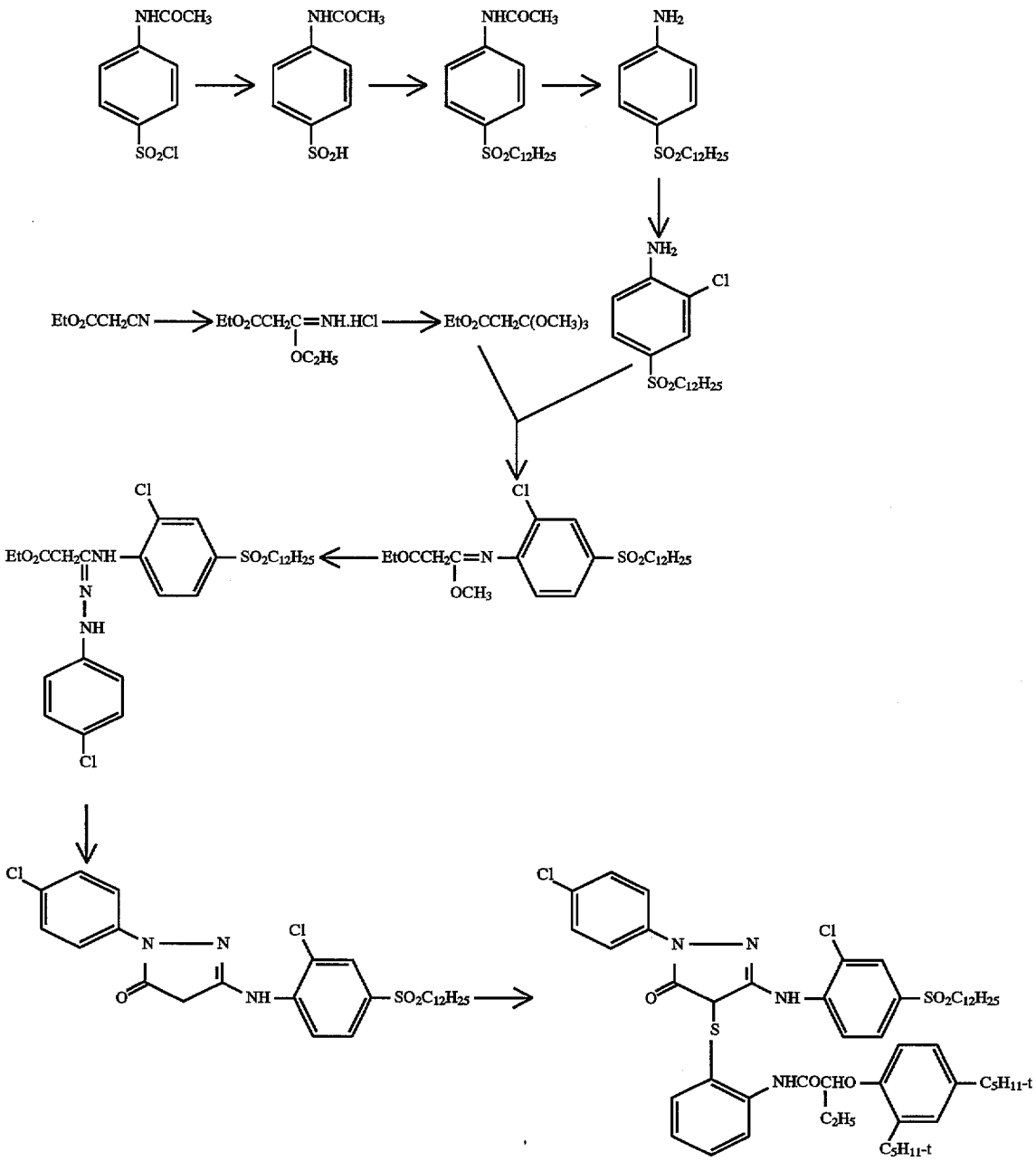

Preparation of 4-Acetamidobenzenesulfinic acid

4-Acetamidobenzenesulfonyl chloride (400 g, 1.72 moles) was added to a stirred solution of sodium sulfite (431.7 g, 3.42 moles) in water (2 liters). An aqueous solution of 50% sodium hydroxide was added dropwise over 35 minutes using a cooling bath to keep the temperature below 30° C. The pH was thus maintained in the range of 6.5 to 7.0. The mixture was stirred at room temperature for 2 hours and the resulting white solid was filtered off, washed with water and dried at 50° C. The product weight 324.2 g (95% yield) and was used in the next stage without further purification.

Preparation of 4-Dodecylsulfonylacetanilide

4-Acetamidobenzenesulfinic acid (324 g, 1.63 moles) was dissolved in N,N-dimethylformamide (1.6 liters), when anhydrous potassium carbonate (337 g, 244 moles) was added in portion to the stirred solution. This was followed by the addition of 1-bromododecane (472 g, 1.88 moles). The resulting mixture was stirred and heated at 100° C. for 6 hours before being cooled to room temperature. The mixture was poured into water (5 liters) and stirred for 30 minutes. The white solid was filtered off, washed with water and dried. It was recrystallized from methanol (92 liters) to give 521.7 g (87%) of pure product.

Preparation of 4-Dodecylsulfonylaniline

A mixture of 4-dodecylsulfonylacetanilide (594 g, 1.62 moles) and dioxane (2.3 liters) was stirred and heated to 70° C. Concentrated hydrochloric acid (3.45 liters) was added over 5 minutes to the resulting solution and the mixture was stirred and heated under reflux for a further 2 hours. At first there was a tendency for the mixture to foam excessively, so that the heating mantle had to be removed for a time to control the foaming. The mixture was cooled to room temperature before being added to stirred ice/water (5 liters) containing sodium hydroxide (200 g). The resulting solid was filtered off, washed with water and dried. The product weighed 520 g (99% yield).Calc. C, 66.42; H, 9.60; N, 4.30; S, 9.85. Found C, 66.25; H, 9.22; N, 4.26; S, 9.46%.

Preparation of 2-Chloro-4-dodecylsulfonylaniline

A stirred mixture of 4-dodecylsulfonylaniline (519.6 g 1.6 moles), 1,2-dichloroethane (2.5 liters) and N-chlorosuccinimide (110 g 0.825 moles) was heated under reflux for 45 minutes. A further 60 g (0.45 moles) of N-chlorosuccinimide was added and heating was continued for 45 minutes. A further 53 g of N-chlorosuccinimide (0.40 moles) was added and heating was maintained for another hour. The total amount of N-chlorosuccinimide was used 223 g (1.67 moles). TLC showed no starting material. The solvent was removed on the rotovapor and the residue was dissolved in ethyl acetate (2 liters). The solution was washed with 3×15 liters of hot water, then it was dried over magnesium sulfate and the solvent was removed. The product was recrystalized twice from petroleum ether (bp 60°–80° C.) containing a little ethyl acetate to give 513.6 g (89%) of pure material.

Calc. C, 60.06; H, 8.40; Cl, 9.85; N, 3.89; S, 8.91. Found C, 59.88; H, 7.96; Cl, 9.91; N, 3.86; S, 8.59%.

Preparation of Ethyl 3-ethoxy-3-iminopropionate Hydrochloride

Hydrogen chloride gas was bubbled through a stirred solution of ethyl cyanoacetate (900 g. 7.96 moles), ethanol (410 ml, 7.0 moles) and diethyl ether (2.4 liters). The temperature was kept below 15° C. by use of a cooling bath. After 3.5 hours 395 g (10.8 moles) of hydrogen chloride had been absorbed. The mixture was kept in a cold room for 72 hours. Then the resulting white, crystalline product was filtered off, washed first with diethyl ether, then with petroleum-ether (b.p. 60°–80° C.) and dried under vacuum. The product weighed 1210 g (88% yield).

Preparation of Ethyl 3,3,-trimethoxypropionate

Ethyl 3-ethoxy-3-iminopropionate hydrochloride (1210 g, 6.19 moles) was stirred with methanol (3 liters at room temperature for 18 hours). The precipitated ammonium chloride was filtered off and most of the methanol was removed on the rotavapor. The residue was dissolved in diethyl ether (1.5 liters) and the solution was washed first with water (1.5 liters) then with 2×1.5 liters of 10% sodium carbonate solution. The ether layer was separated off, dried over magnesium sulfate, and the solvent was removed on the rotavapor to give a colorless liquid. The weight of product was 867 g (73% yield). The structure was confirmed by NMR and IR spectroscopy.

Preparation of 3-(2-Chloro-4-dodecylsulfonylanilino)-4,5-dihydro-5-oxo-1-(4-chlorophenyl)-1H-pyrazole A stirred mixture of 2-chloro- 4-dodecylsulfonylaniline (21.9 g, 0.061 moles), ethyl 3,3,3-trimethoxypropionate (11.7 g, 0.061 moles) and toluene (100 ml) was heated in an oil-bath at 110° C. until solution was attained. Concentrated sulfuric acid (4 drops) was added and the stirred mixture was heated for 2–25 hours allowing volatiles to distill off. The solution was cooled and the solvent was removed on the rotavapor to leave an oil. The oil was dissolved in glacial acetic acid (100 ml) and 4-chlorophenylhydrazine (8.7 g, 0.061 moles) was added. The mixture was stirred at room temperature for 22 hours. Then the resulting solid was filtered off, washed with methanol and dried. The solid was purified by trituration with ethyl acetate to give the product as a pale yellow solid weighing 20.1 g (60%).

Calc. C, 58.68; H, 6.38; Cl, 12.83; N, 7.61; S, 5.80. Found C, 58.42; H, 6.11; Cl, 12.81; N, 7.57; S, 5.78 g.

Preparation of 3-(2-Chloro-4-dedecylsulfonylanilino)-4,5-dihydro-5-oxo-1-(4-chlorophenyl)-4-(2,4-di-t-pentylphenoxy-2-butyramidophenylthio)-1H-pyrazole Sulfuryl chloride 91.4 g, 0.010 moles) was added slowly to a stirred solution of 2-(2,4-di-t-pentylphenoxy-2-butyramido)phenyl disulfide (8.5 g, 0.010 moles) in dichloromethane (40 ml). The solution was stirred at room temperature for 1.25 hours. Then volatiles were removed on the rotavapor to leave an oil. A solution of 3-(2-chloro-4-dodecylsulfonylanilino)-4,5-dihydro-5-oxo-1-(4-chlorophenyl)-1H-pyrazole (10.0 g, 0.018 moles) in N,N-dimethylformamide (50 ml) was added rapidly to oil and the mixture was stirred for 25 hours at room temperature. The mixture was filtered to remove a small amount of solid and the filtrate was poured slowly into 3M hydrochloric acid (750 ml). The resulting bright yellow solid was filtered off, washed with water and dried. The solid was purified by chromatography on silica gel eluting with a 1:4 mixture of ethyl acetate and petroleum-ether (bp 60°–80° C.). The pure product was obtained as a glass. The glass was dissolved in glacial acetic acid (40 ml) and the solution was slowly added dropwise to stirred water (750 ml). This enabled the product to be obtained as a white solid, which was filtered off, washed with water and dried. The product weight 5.4 g (31% yield).

Calc C, 65.10; H, 7.16; Cl, 7.27; N, 5.73. Found C, 64.43; H, 6.76; Cl, 7.16; N, 5.67%.

Photographic Examples

The couplers of the present invention along with the appropriate control couplers were incorporated into test single-layer photographic coatings according to the following diagrams in order to demonstrate their improved light stability, hue (both in terms of λmax and printer compatibility with other classes of magenta couplers) and increased activity.

Single Layer Format A:

Overcoat: Gelatin at 1.50 g/m$^2$

Emulsion Layer: Silver bromoiodide at 1.61 g/m$^2$ Coupler at 1.042 g/m$^2$Gelatin at 2.42 g/m$^2$Bis(vinylsulphonyl) methane at 0.06 g/m$^2$ Support: Cellulose Acetate Aqueous dispersions of the couplers were prepared by methods known in the art using 1:0.5:1.5 (weight ratio) of coupler:tricesylphosphate:2-(1-butoxyethoxy)ethyl acetate following by washing for 6 hours at 4 degrees C. and pH 6.0 to remove the auxiliary solvent. These coatings were given a stepped exposure and processed through a standard C41 process as described in *British Journal of Photography Annual* (1988), pp 196–198 using the following steps and process times:

| | |
|---|---|
| Developer | 2.5 minutes |
| Bleach | 4.0 minutes |
| Wash | 2.0 minutes |
| Fix | 4.0 minutes |
| Wash | 2.0 minutes |

Gamma (maximum slope) was obtained from plots of green density versus log exposure and is a measure of activity towards oxidized developer. λmax is the wavelength in nm at maximum absorbance. Half bandwidth (HBW) is the width (in nm) of the absorbance curve at half the maximum height. Light stability was measured using dye patches, protected with a WRATTEN 2B gelatin filter, mounted 4 cm from a pair of 85W, 6 ft color matching fluorescent tubes in a chamber maintained at 60° C. and 70% relative humidity. Loss in density at maximum absorbance after 200 hours is a direct measure of light fade. Note that comparative samples CM-8, CM-9, CM-11, and CM-16 were severely aggregated with the formation of an orange colored species, hence a hypsochromic shift in λmax.

TABLE I

Single Layer Format A Photographic Data

| Sample No. | Comp/Inv | Coupler | λmax (HBW) | Gamma | Light Fade |
|---|---|---|---|---|---|
| 1 | Comp | CM-1 | 556 (96) | 1.97 | −.40 |
| 2 | Comp | CM-2 | 557 (92) | 3.80 | −.68 |
| 3 | Comp | CM-3 | 545 (81) | 3.76 | −.69 |
| 4 | Comp | CM-4 | 547 (82) | 3.66 | −.68 |
| 5 | Comp | CM-5 | 547 (90) | 2.63 | −.18 |
| 6 | Comp | CM-6 | 546 (85) | 4.69 | −.50 |
| 7 | Comp | CM-7 | 544 (88) | 4.70 | −.78 |
| 8 | Comp | CM-8 | 463 (96) | 0.82 | +.01 |
| 9 | Comp | CM-9 | 532 (99) | 3.48 | −.13 |
| 10 | Comp | CM-10 | 543 (99) | 5.30 | −.13 |
| 11 | Inv | M-1 | 551 (97) | 5.30 | −.08 |
| 12 | Inv | M-2 | 552 (96) | 4.80 | −.09 |
| 13 | Inv | M-3 | 552 (92) | 4.73 | −.10 |
| 14 | Inv | M-4 | 547 (102) | 2.83 | −.10 |

Single Layer Format B:

Overcoat: Gelatin at 2.69 g/m$^2$Bis(vinylsulphonyl) methylether at 1.75% (by weight) of total gel Emulsion Layer: Silver bromoiodide at 1.08 g/m$^2$Coupler at 0.57 mmoles/m$^2$Gelatin at 3.77 g/m$^2$ Support: Cellulose Acetate with Rem-Jet Backing Aqueous dispersions were prepared using a weight ratio of 1 coupler:0.8 tricresylphosphate:0.2 N,N-dibutyl-2-butoxy-5-t-octylaniline as described for Format A except for CM-1, CM-14 and M-6 (1:5 N,N-dibutyllauramide); CM-13 and CM-14 (1:1 tricresylphosphate); CM-4 in Sample 19 and M-1 in Sample 29 (1:0.7 tricresylphosphate:0.3 N,N-dibutyl-2-butoxy-5-t-octylaniline; M-1 in Sample 30 (1:0.7 p-dodecylphenol:0.3 N,N-dibutyl-2-butoxy-5-t-octylaniline) and M-1 in Sample 31 (1:1 N,N-dibutyllauramide). The coatings were exposed and processed as described for Format A. Light fade was measured in loss at maximum density using dye patches, protected by a WRATTEN 2B gelatin filter, exposed to a 50 Klux high intensity light source for 5 days.

TABLE II

Single Layer Format B Photographic Data

| Sample No. | Comp/Inv | Coupler | λmax (HBW) | Gamma | Light Fade |
|---|---|---|---|---|---|
| 15 | Comp | CM-1 | 540 (93) | 0.65 | −.056 |
| 16 | Comp | CM-2 | 559 (97) | 2.10 | −.706 |
| 17 | Comp | CM-3 | 543 (83) | 2.23 | −.253 |
| 18 | Comp | CM-4 | 547 (83) | 1.83 | −.061 |
| 19 | Comp | " | 546 (83) | 1.49 | −.102 |
| 20 | Comp | CM-5 | 488 (105) | 2.01 | −.095 |
| 21 | Comp | CM-10 | 544 (119) | 2.56 | −.037 |
| 22 | Comp | CM-11 | 464 (98) | 0.49 | |
| 23 | Comp | CM-12 | 547 (95) | 2.58 | −.013 |
| 24 | Comp | CM-13 | 541 (85) | 1.14 | −.097 |

TABLE II-continued

Single Layer Format B Photographic Data

| Sample No. | Comp/Inv | Coupler | λmax (HBW) | Gamma | Light Fade |
|---|---|---|---|---|---|
| 25 | Comp | CM-14 | 535 (100) | 0.79 | −.028 |
| 26 | Comp | CM-15 | 548 (92) | 1.25 | −.007 |
| 27 | Comp | CM-16 | 527 (118) | 1.33 | −0.124 |
| 28 | Inv | M-1 | 549 (101) | 2.59 | −.019 |
| 29 | Inv | " | 548 (103) | 2.22 | +.026 |
| 30 | Inv | " | 547 (111) | 1.50 | +.030 |
| 31 | Inv | " | 547 (99) | 1.96 | −.067 |
| 32 | Inv | M-2 | 550 (103) | 2.21 | +.031 |
| 33 | Inv | M-6 | 537 (87) | 0.88 | +.001 |

The compounds of the invention also cause unexpected overall improvements in light stability when coated in the same imaging layer with other types of less light stable magenta image couplers. This can be demonstrated by preparing model photographic coatings according to Single Layer Format A in which the couplers are mixed at the indicated mole % as separate dispersions at a constant total coupler molar level and tested as described previously. It can be seen from Table 3 that, in each case, the overall light stability of the combination is improved more than the amount predicted by simple linear extrapolation.

TABLE III

Light Stability of Combination of Couplers (Format A)

| Sample | Coupler 1 | Coupler 2 | Light Fade |
|---|---|---|---|
| 34 | CM-2(100%) | | −0.90 |
| 35 | CM-2 (50%) | M-1 (50%) | −0.48 |
| 36 | CM-3 (100%) | | −0.63 |
| 37 | CM-3 (50%) | M-1 (50%) | −0.18 |
| 38 | | M-1 (100%) | −0.10 |

Single Layer Format C:

Overcoat: Gelatin at 1.4 g/m$^2$ Bis(vinylsulfonyl)methane at 0.14 g/m$^2$

UV Layer: Gelatin at 1.33 g/m$^2$ 2-(2H-benzotriazol-2-yl)-4,6-bis(1.1-dimethylpropyl)phenol at 0.73 g/m$^2$ Tinuvin 326 (trademark of Ciba-Geigy) at 0.13 g/m$^2$ Emulsion Layer: Gelatin at Layer: 1.61 g/m$^2$ Green sensitive AgCl emulsion at 0.17 g/m$^2$ Coupler at 3.29×10$^{-4}$ moles/m$^2$ Interlayer: Gelatin at 3.23 g/m$^2$ Support: Gel-subbed, polyeththylene-coated opaque paper The coupler dispersions in this format were prepared using the following solvent weight to coupler weight ratio: tritolyl phosphate at 1:1, N,N-dibutyl-2-butoxy-5-t-octylaniline at 1.17 and CG21-40 (trademark of Ciba-Geigy) at 0.17. Processed samples were prepared by exposing the coatings through a step wedge and processing (35 degrees C.) as follows (amounts per liter of solution): Developer (triethanolamine (12.41 g), Blankophor REU (trademark of Mobay Co.) (2.30 g), lithium polystyrene sulfonate (0.09 g), N,N-diethylhydroxylamine (4.59 g), N-(2-(4-amino-3-methylphenyl)ethylamino)-ethyl)methanesulfonamide sesiquisulfate monohydrate (5.00 g), 1-hydroxyethyl-1,1-diphosphonic acid (0.49 g), anhydrous potassium carbonate (21.16 g), potassium chloride (1.60 g), potassium bromide (0.007 g) and pH adjusted to 10.4) at 26.7 degrees C. for 0.75 min; Bleach-Fix (ammonium thiosulfate (71.85 g), ammonium sulfite (5.10 g), sodium metabisulfite (10.0 g), acetic acid (10.2 g), ammonium ferric ethylenediaminetetraacetate (48.58 g), ethylenediaminetetraacetic acid (3.86 g) and pH adjusted to 6.7 at 26.7 degrees C.) for 0.75 min and water wash for 1.5 min. Light fade (loss in density from an original density of 1.0) of these coatings were measured after the indicated times and light conditions. As demonstrated by the data in Table IV, the coupler of the invention is more stable towards light fade than the comparative couplers.

TABLE IV

| Light Fade in Format C (Paper Format) | | | |
|---|---|---|---|
| Sample | Coupler | Conditions | Light Fade |
| 39 | CM-13 | 6 weeks, 5.4 Klux Daylight | −0.11 |
| | | 12 weeks, 5.4 Klux Daylight | −0.19 |
| | | 24 weeks, 5.4 Klux Daylight | −0.40 |
| | | 2 weeks, 50 Klux Daylight | −0.22 |
| | | 4 weeks, 50 Klux Daylight | −0.49 |
| 40 | CM-4 | 6 weeks, 5.4 Klux Daylight | −0.09 |

TABLE IV-continued

| Light Fade in Format C (Paper Format) | | | |
|---|---|---|---|
| Sample | Coupler | Conditions | Light Fade |
| | | 12 weeks, 5.4 Klux Daylight | −0.18 |
| | | 24 weeks, 5.4 Klux Daylight | −0.51 |
| | | 2 weeks, 50 Klux Daylight | −0.19 |
| | | 4 weeks, 50 Klux Daylight | −0.56 |
| 41 | M-1 | 6 weeks, 5.4 Klux Daylight | −0.03 |
| | | 12 weeks, 5.4 Klux Daylight | −0.07 |
| | | 24 weeks, 5.4 Klux Daylight | −0.20 |
| | | 2 weeks, 50 Klux Daylight | −0.06 |
| | | 4 weeks, 50 Klux Daylight | −0.18 |

The structures of the comparative couplers used in Tables I through IV are:

CM-1:

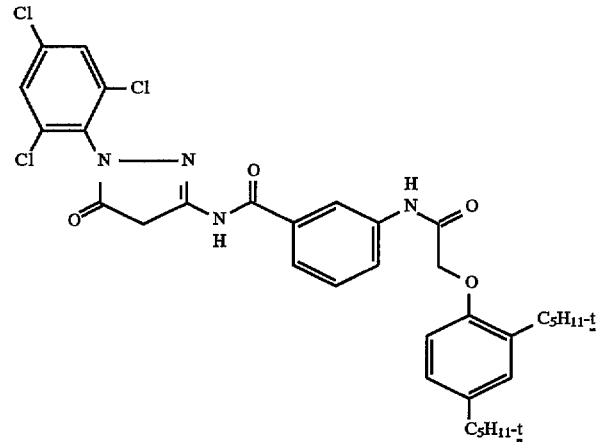

CM-2:

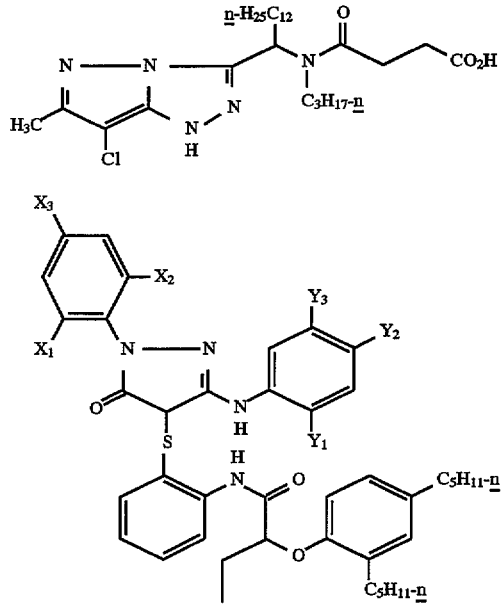

-continued
| Coupler | $X_1$ | $X_2$ | $X_3$ | $Y_1$ | $Y_2$ | $Y_3$ |
|---|---|---|---|---|---|---|
| CM-3 | Cl | Cl | Cl | Cl | H | $-NHCOC_{13}H_{27}$-n |
| CM-4 | Cl | Cl | Cl | Cl | $-SO_2C_{12}H_{25}$-n | H |
| CM-5 | Cl | Cl | H | Cl | $-SO_2C_{12}H_{25}$-n | H |
| CM-6 | Cl | Cl | Cl | Cl | $-SO_2NHC_{12}H_{25}$-n | H |
| CM-7 | Cl | Cl | Cl | H | $-SO_2C_{12}H_{25}$-n | H |
| CM-8 | H | H | Cl | Cl | H | $-NHCOC_{13}H_{27}$-n |
| CM-9 | H | H | Cl | Cl | H | $-NHCOCH(C_2H_5)O-C_6H_3(C_5H_{11}$-n$)-C_5H_{11}$-n |
| CM-10 | H | H | Cl | Cl | $-CO_2C_{12}H_{25}$-n | H |
| CM-12 | H | H | H | Cl | $-SO_2C_{12}H_{25}$-n | H |
CM-11:
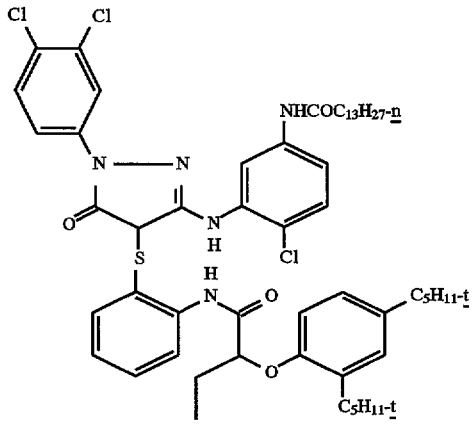
CM-13:
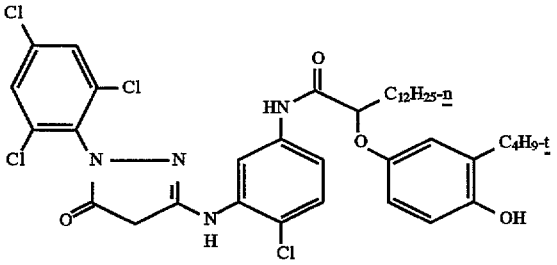
CM-14:
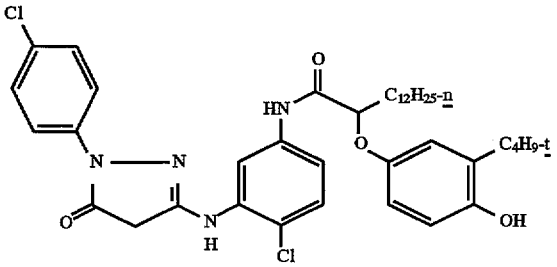
CM-15:
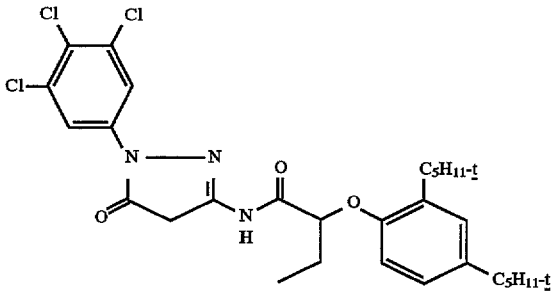

-continued

CM-16:

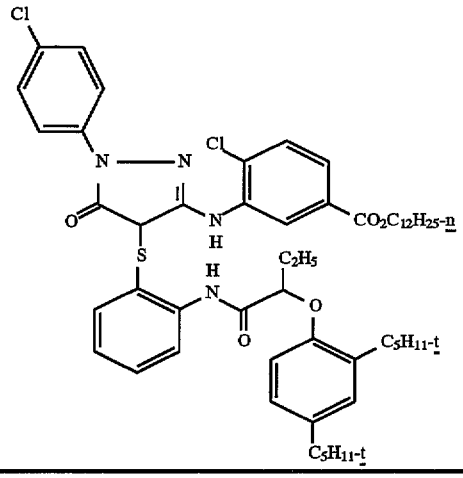

The results in Tables I, II, III, and IV clearly demonstrate that only the couplers of the invention show improved results for the desired combination of high reactivity, light stability and broad magenta hue without dye aggregation.

In order to further demonstrate the utility of the invention, multilayer films were produced by coating the following layers on a cellulose triacetate film support (coverage are in grams per meter squared, emulsion sizes as determined by the disc centrifuge method and are reported in Diameter× Thickness in microns):

Layer 1 (Antihalation layer): black colloidal silver sol at 0.140; gelatin at 2.15; OxDS-1 at 0.108, DYE-1 at 0.049; DYE-2 at 0.017 and DYE-3 at 0.014.

Layer 2 (Slow cyan layer): a blend of three red sensitized (all with a mixture of RSD-1 and RSD-2) silver iodobromide emulsions: (i) a large sized tabular grain emulsion (1.3× 0.118, 4.1 mole % I) at 0.522 (ii) a smaller tabular emulsion (0.85×0.115, 4.1 mole % I) at 0.337 and (iii) a very small tabular grain emulsion (0.55×0.115, 1.5 mole % I) at 0.559; gelatin at 2.85; cyan dye-forming coupler C-1 at 0.452; DIR coupler DIR-1 at 0.043; bleach accelerator releasing coupler B-1 at 0.054 and anti-foggant 4-hydroxy-6-methyl-1,3,3a,7-tetraazaindene at 0.016.

Layer 3 (Fast cyan layer): a red-sensitized (same as above) tabular silver iodobromide emulsion (2.2×0.128, 4.1 mole % I) at 0.086; cyan coupler C-1 at 0.081; DIR-1 at 0.034; MC-1 at 0.043; gelatin at 1.72 and anti-foggant 4-hydroxy-6-methyl-1,3,3a,7-tetraazaindene at 0.010.

Layer 4 (interlayer): gelatin at 1.29.

Layer 5 (Slow magenta layer): a blend of two green sensitized (both with a mixture of GSD-1 and GSD-2) silver iodobromide emulsions: (i) 0.54×0.091, 4.1 mole % iodide at 0.194 and (ii) 0.52×0.085, 1.5 mole % iodide at 0.559; magenta dye forming coupler at the indicated laydown; gelatin at 1.08 and anti-foggant 4-hydroxy-6-methyl-1,3,3a,7-tetraazaindene at 0.005.

Layer 6 (Mid magenta layer): a blend of two green sensitized (same as above) tabular silver iodobromide emulsions (i) 1.3×0.113, 4.1 mole % I at 0.430 and (ii) 0.54×0.91, 4.1 mole % I at 0.172; magenta dye forming coupler at the indicated laydown; MC-2 at 0.015; DIR-2 at 0.016; gelatin at 2.12 and anti-foggant 4-hydroxy-6-methyl-1,3, 3a,7-tetraazaindene at 0.003.

Layer 7 (Fast magenta layer): a green sensitized tabular silver iodobromide (1.8×0.127, 4.1 mole % I) emulsion at 0.689; gelatin at 1.61; magenta dye forming coupler at the indicated laydown; MC-2 at 0.054 and DIR-3 at 0.003.

Layer 8 (Yellow filter layer): gelatin at 0.86; Carey-Lea silver at 0.043 and OxDS-2 at 0.054.

Layer 9 (Slow yellow layer): an equal blend of three blue sensitized (both with YSD-1) tabular silver iodobromide emulsions (i) 0.50×0.085, 1.5 mole % I (ii) 0.60 diameter, 3% mole I and (iii) 0.68 diameter, 3 mole % I at a total of 0.430; yellow dye forming coupler Y-1 at 0.699; yellow dye forming coupler Y-2 at 0.215; DIR-4 at 0.086; C-1 at 0.097 and gelatin at 2.066.

Layer 10 (Fast yellow layer): two blue sensitized (with YSD-1) tabular silver iodobromide emulsions (i) 3.1× 0.137, 4.1 mole % I at 0.396 (ii) 0.95 diameter, 7.1 mole % I at 0.47; Y-2 at 0.131; Y-1 at 0.215; DIR-4 at 0.075; C-1 at 0.011; B-1 at 0.008 and gelatin at 1.08.

Layer 11 (Protective overcoat and UV filter layer): gelatin at 1.61; silver bromide Lippman emulsion at 0.215; DYE-4 and DYE-5 (1:1 ratio) at a total of 0.023 and bis (vinylsulfonyl)methane hardener at 1.6% of total gelatin weight.

Surfactants, coating aids, emulsion addenda, sequestrants, lubricants, matte and tinting dyes were added to the appropriate layers as is common in the art. Table 5 lists the type and laydown (in g/m$^2$) of magenta coupler in each green sensitive layer of the samples.

TABLE V

Magenta Coupler and Laydowns for Multilayer Examples

| Sample | Comp/Inv | Magenta | Layer 5 | Layer 6 | Layer 7 |
|---|---|---|---|---|---|
| ML-1 | Comp | CM-3 | 0.258 | 0.065 | 0.043 |
| ML-2 | Comp | CM-2 | 0.199 | 0.060 | 0.036 |
| ML-3 | Inv | M-13 | | 0.065 | 0.043 |
| | | M-1 | 0.161 | | |
| ML-4 | Inv | M-1 | 0.161 | 0.043 | 0.027 |

The structures of the materials used in the multilayer examples are as follows:

Dye-1:
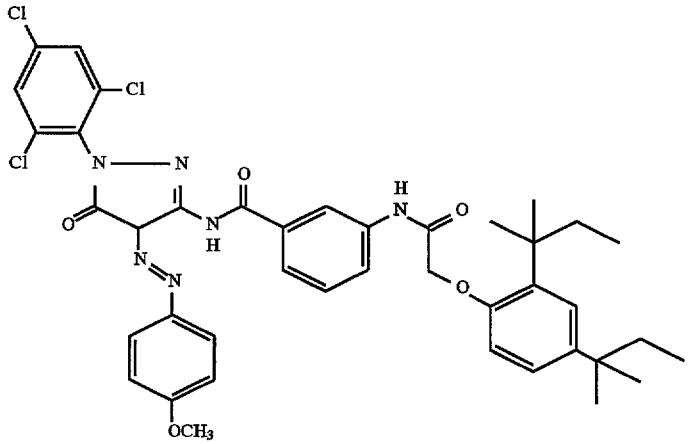
Dye-2:
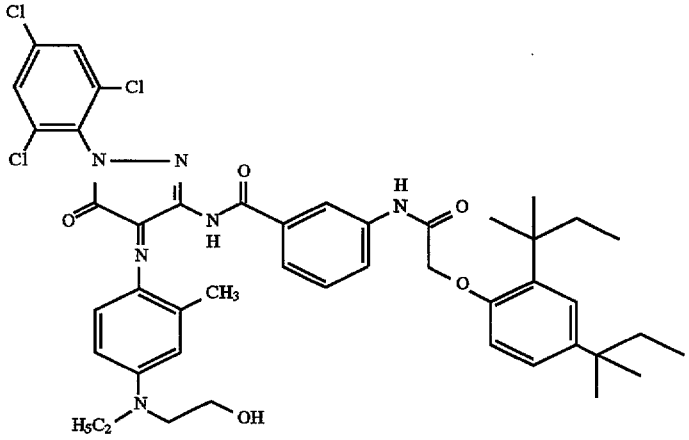
Dye-3:
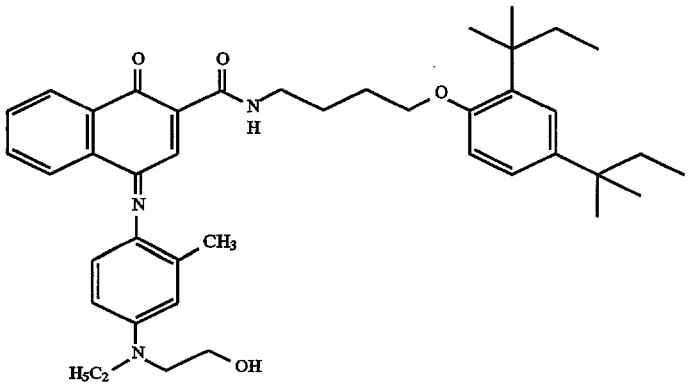
Dye-4:
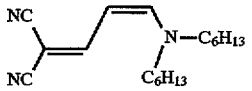

-continued
Dye-5:
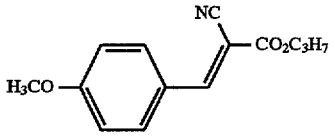
OxDS-1:
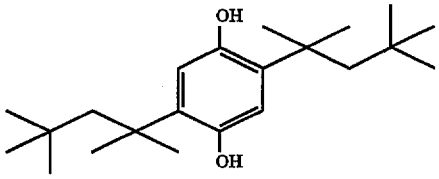
OxDS-2:
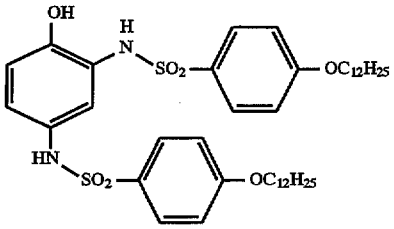
C-1:
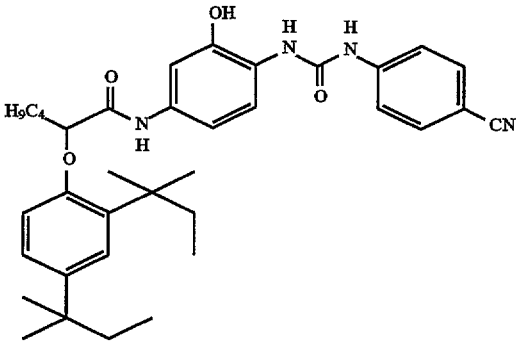
Y-1:
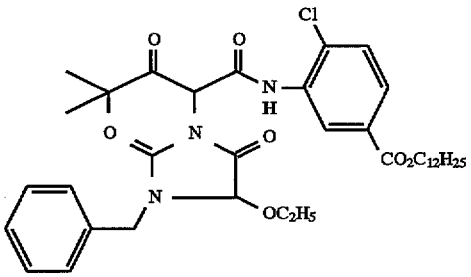

-continued
Y-2:
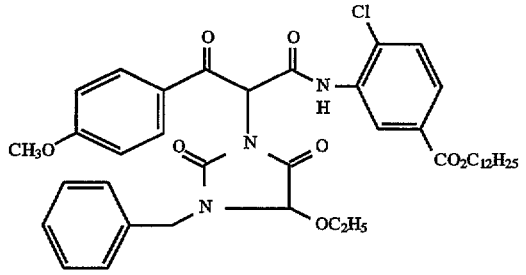
B-1:
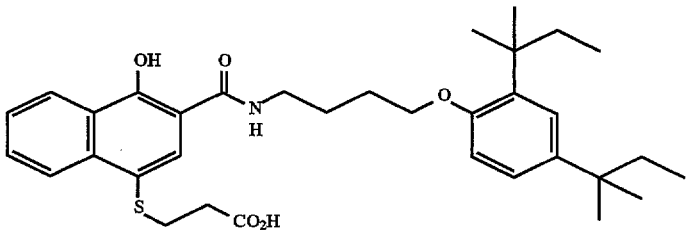
MC-1:
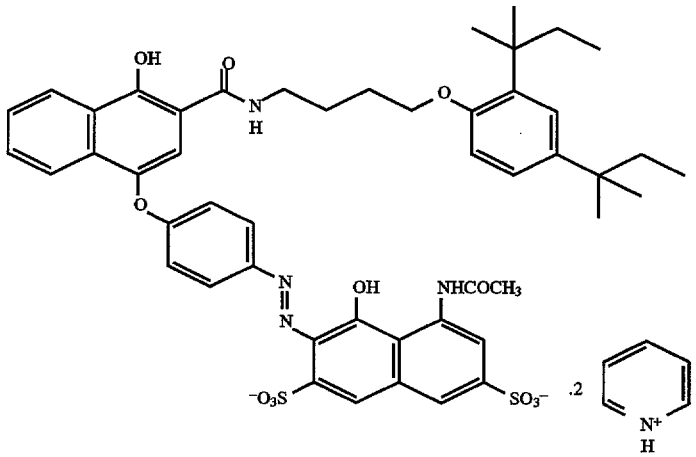
MC-2:
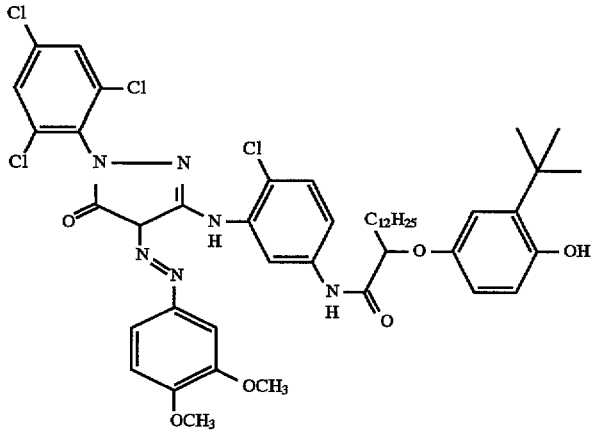

-continued
DIR-1:
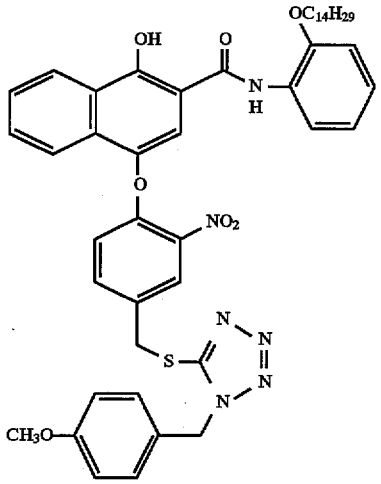
DIR-2:
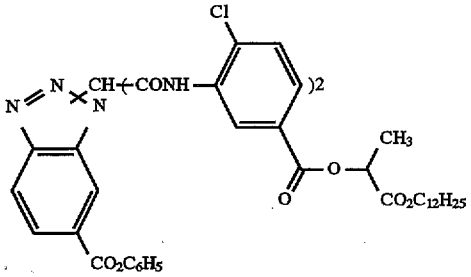
DIR-3:
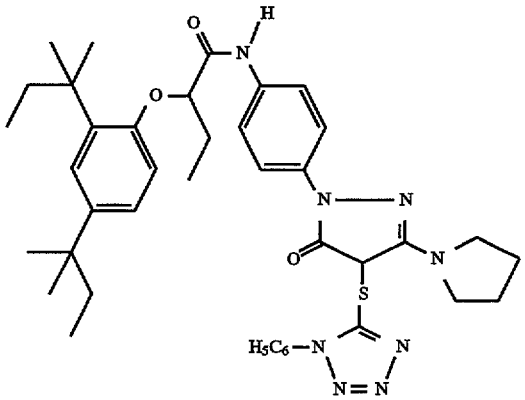

-continued
DIR-4:
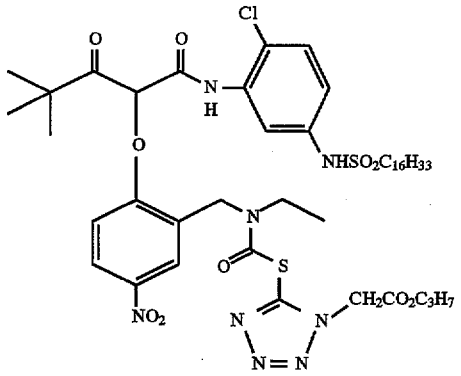
RSD-1:
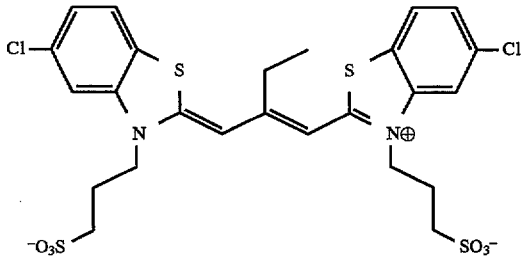
RSD-2:
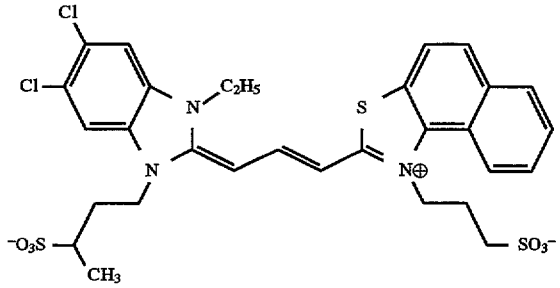
GSD-1:
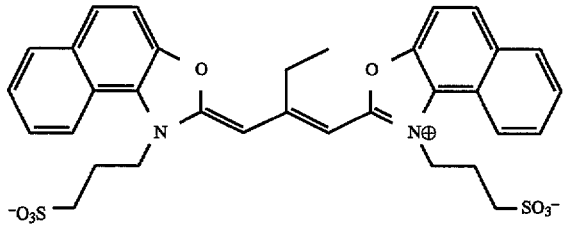
GSD-2:
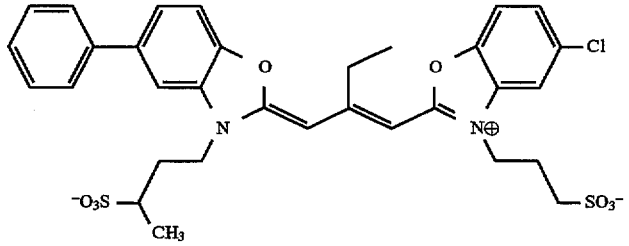

-continued

BSD-1:

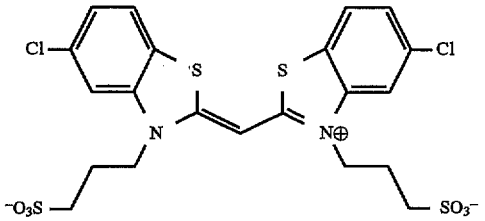

These multilayer examples were given a stepped neutral exposure and developed using the C-41 process (3 minute 15 second development time) as for the single layer examples. Density at 550 nm and at 580 nm were measured at low exposure (Dmin+0.15), midscale (Dmin+1.2) and at Dmax. $D_{580}/D_{550}$ is the ratio of density at 580 nm to 550 nm. Sample ML-1 represents a multilayer coating using a 1-(trichlorophenyl)-3-anilino-5-pyrazolone magenta image coupler, which is used in some commercially available products, but which is insufficient in density at 580 nm (relative to the amount of density at 550 nm) compared to ML-2 which contains a pyrazolotriazole magenta image coupler, a type of magenta coupler also used in commercially available products. Because of this density mismatch at 580 nm (relative to density at 550 nm), these two films are not printer compatible; that is, will not produce prints with identical color balance on all types of printers used in the photofinishing trade. However, use of the inventive 1-(4-chlorophenyl)-5-pyrazolone as the magenta image coupler, which has an unexpectedly broad hue with increased density at 580 nm relative to 550 nm, improves printer compatibility. This is easily seen in Table VI in which $D_{580}/D_{550}$ of the inventive samples are much closer to that of ML-2. In addition, prints made from the inventive coatings using KODAK Class 35, KODAK KDPC, KODAK Model 1202 and AGFA MSP brand printers (all commercially available printers in which ML-1 and ML-2 do not produce prints with similar color balance) were judged to have color balance close to ML-2.

TABLE VI

Multilayer Printer Compatibility

| | | $D_{580}/D_{550}$ at exposure | | |
|---|---|---|---|---|
| Sample No. | Comp/Inv | Low | Midscale | Dmax |
| ML-1 | Comp | .839 | .706 | .670 |
| ML-2 | Comp | .908 | .846 | .868 |
| ML-3 | Inv | .843 | .751 | .772 |
| ML-4 | Inv | .884 | .808 | .836 |

The entire contents of the various patent applications, patents and other publications referred to in this specification are incorporated herein by reference.

What is claimed is:

1. A light sensitive photographic silver halide emulsion layer having associated therewith a magenta coupler having formula (I):

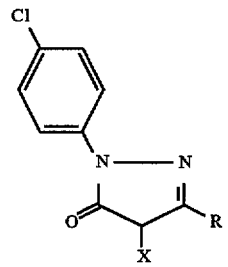

(I)

wherein:

R represents a ballasted monosubstituted amino group, wherein the amino group is an anilino group, which enables the coupler to form, upon development with 4-amino-3-methyl-N-ethyl-N-(2-hydroxyethyl)aniline sulfate developing agent, a magenta dye having a wavelength of maximum absorbance of 545 nm or greater; and X represents hydrogen or a coupling-off group.

2. The layer of claim 1 wherein R contains a substituent selected from the group consisting of chloride, sulfone, carbamoyl, and sulfamoyl groups.

3. The layer of claim 2 wherein R contains a sulfone.

4. The layer of claim 1 wherein at least 10 alkyl carbons are contained in R.

5. The layer of claim 1 wherein X is hydrogen.

6. The layer of claim 1 wherein X is a coupling-off group.

7. The layer of claim 6 wherein X is a halogen, aryloxy, arylthio or a nitrogen heterocyclic group.

8. The layer of claim 1 additionally containing a second magenta dye forming coupler not coming within formula (I).

9. The layer of claim 8 wherein the second magenta dye forming coupler is a pyrazolone or a pyrazoloazole compound.

10. A photographic element comprising a layer as described in claim 1.

11. A method of forming an image comprising contacting the element of claim 1 with a color developing chemical after the element has been imagewise exposed to light.

12. A light sensitive photographic silver halide emulsion layer having associated therewith a magenta coupler that has formula (II):

(II)

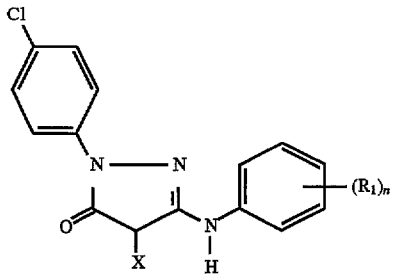

wherein:

X is hydrogen or a coupling-off group;

each $R_1$ independently represents a substituent such that the sum total of the Hammett σ-para constants of the n substituents is 0.68 or greater, and n=1 to 5; provided that the selection of the $R_1$ substituents is sufficient to ballast the coupler.

13. The layer of claim 12 wherein at least one $R_1$ substituent is selected from the group consisting of chloride, sulfone, carbamoyl, and sulfamoyl groups.

14. The layer of claim 12 wherein at least one $R_1$ is sulfone.

15. The layer of claim 12 wherein at least 10 alkyl carbons are contained in $R_1$.

16. The layer of claim 12 wherein X is hydrogen.

17. The layer of claim 12 wherein X is a coupling-off group.

18. The layer of claim 17 wherein X is a halogen, aryloxy, arylthio or a nitrogen heterocyclic group.

19. A photographic element comprising a layer as described in claim 9.

20. A light sensitive photographic silver halide emulsion layer having associated therewith a magenta coupler that has formula (III):

(III)

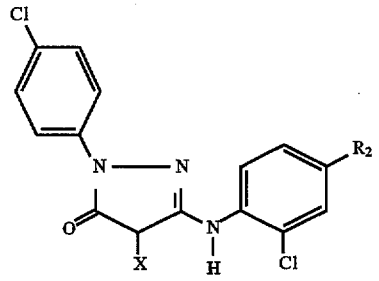

wherein:

X is as above;

$R_2$ is a ballasted sulfone (—$SO_2R_3$), sulfamoyl (—$SO_2NR_3R_4$) or carbamoyl (—$CONR_3R_4$) group in which $R_3$ is an alkyl or aryl group and $R_4$ is hydrogen or an alkyl or aryl group.

* * * * *